US012654071B2

(12) United States Patent
Price et al.

(10) Patent No.: US 12,654,071 B2
(45) Date of Patent: Jun. 16, 2026

(54) TENNIS BALLS

(71) Applicant: J.PRICE(BATH)LIMITED, Somerset (GB)

(72) Inventors: Derek Price, Wiltshire (GB); Louise Rainbow, Wiltshire (GB)

(73) Assignee: J PRICE (BATH) LIMITED, Somerset (GB)

( * ) Notice: Subject to any disclaimer, the term of this patent is extended or adjusted under 35 U.S.C. 154(b) by 147 days.

(21) Appl. No.: 18/012,147

(22) PCT Filed: Jun. 21, 2021

(86) PCT No.: PCT/EP2021/066891
§ 371 (c)(1),
(2) Date: Dec. 21, 2022

(87) PCT Pub. No.: WO2021/259884
PCT Pub. Date: Dec. 30, 2021

(65) Prior Publication Data

US 2023/0271063 A1 Aug. 31, 2023

(30) Foreign Application Priority Data

Jun. 22, 2020 (GB) ..... 2009520

(51) Int. Cl.
*A63B 39/00* (2006.01)
*A63B 102/02* (2015.01)

(52) U.S. Cl.
CPC ..... *A63B 39/00* (2013.01); *A63B 2039/003* (2013.01); *A63B 2039/006* (2013.01); *A63B 2102/02* (2015.10)

(58) Field of Classification Search
CPC ..... A63B 39/00; A63B 2039/003; A63B 2039/006; A63B 2102/02
See application file for complete search history.

(56) References Cited

U.S. PATENT DOCUMENTS 2,053,450 A 9/1936 Douglas et al.
2,060,962 A * 11/1936 Twiss ..... B29D 22/04 264/28
4,065,126 A * 12/1977 Mantz ..... A63B 69/38 473/462
4,241,118 A * 12/1980 Skelton ..... B29C 63/0065 428/36.1
5,209,471 A 5/1993 Horiuchi et al.
(Continued)

FOREIGN PATENT DOCUMENTS

AU 6881294 A * 2/1995
CN 2813009 Y * 9/2006
(Continued)

OTHER PUBLICATIONS

Translation of CN 2813009, Dated Sep. 6, 2006, pp. 1-3.*
(Continued)

*Primary Examiner* — Audrey B. Walter
(74) *Attorney, Agent, or Firm* — Nicholas J. Landau; Maynard Nexsen PC

(57) ABSTRACT

A tennis ball comprising a hollow core and a cover, the core being formed from a composition including rubber, in which the composition comprises recycled tennis ball material.

16 Claims, 1 Drawing Sheet

(56) References Cited

U.S. PATENT DOCUMENTS

| | | | | | |
|---|---|---|---|---|---|
| 5,976,430 | A * | 11/1999 | Kataoka | B29B 17/02 | 264/36.12 |
| 8,647,467 | B2 * | 2/2014 | Molinari | A63B 47/00 | 156/716 |
| 10,426,229 | B2 * | 10/2019 | Krause | B30B 15/0088 | |
| 10,918,913 | B2 * | 2/2021 | Dillon | A63B 39/06 | |
| 11,247,103 | B2 * | 2/2022 | Simonutti | A63B 37/12 | |
| 2010/0056305 | A1 * | 3/2010 | Hebert | A63B 47/00 | 473/409 |
| 2012/0277043 | A1 | 11/2012 | Rodrigues et al. | | |
| 2013/0165267 | A1 * | 6/2013 | Molinari | A63B 37/0047 | 241/24.1 |
| 2013/0320576 | A1 * | 12/2013 | Ishii | B29B 17/02 | 264/36.12 |
| 2016/0236043 | A1 | 8/2016 | Savelli et al. | | |
| 2020/0070010 | A1 | 3/2020 | Dillon et al. | | |
| 2020/0190289 | A1 * | 6/2020 | Hyodo | A63B 39/02 | |
| 2022/0288813 | A1 * | 9/2022 | Senior | B07B 1/06 | |

FOREIGN PATENT DOCUMENTS

| | | | | | |
|---|---|---|---|---|---|
| CN | 110860073 | A | | 3/2020 | |
| CN | 115008640 | A | * | 9/2022 | |
| DE | 3804104 | A1 | | 8/1988 | |
| EP | 3075798 | A1 | * | 10/2016 | C08K 3/22 |
| GB | 2200849 | A | | 8/1988 | |
| GB | 2596299 | A | | 12/2021 | |
| GB | 2611906 | A | | 4/2023 | |
| JP | 2004016532 | A | * | 1/2004 | |
| JP | 2007000167 | A | * | 1/2007 | |
| KR | 380001790 | B1 | * | 9/1983 | |
| KR | 830001790 | B1 | * | 9/1983 | |
| WO | WO2022250535 | A1 | | 1/2022 | |

OTHER PUBLICATIONS

Anonymous: "ABN Amro to collect and recycle used tennis balls to make Sustainaballs", Jan. 28, 2020, URL:https://www.finextra.com/pressarticle/ 81272/abn-amro-to-collect-and-recycle-used -tennis-balls-to-make-sustainaballs.

Anonymous: "About us", Dec. 31, 2020, URL:https://www.renewaball.com/about_us.html.

International Search Report and Written Opinion for International Application No. PCT/EP2021/066891, mailed Oct. 12, 2021.

Search Report United Kingdom Application No. GB2009520.4, mailed Nov. 26, 2020.

International Preliminary Report on Patentability received for International Patent Application No. PCT/EP2021/066891, mailed on Jan. 5, 2023, 9 pages.

Examination Report received for United Kingdom Patent Application No. GB2009520.4, mailed on Nov. 10, 2023, 05 pages.

Examination Report received for United Kingdom Patent Application No. GB2219628.1, mailed on Dec. 21, 2023 03 pages.

Examination Report received for United Kingdom Patent Application No. GB2219628.1, mailed on Nov. 10, 2023, 02 pages.

Examination Report received for United Kingdom Patent Application No. GB2219628.1, mailed on Feb. 16, 2024, 03 pages.

Examination Report received for United Kingdom Patent Application No. GB2401097.7, mailed on Feb. 19, 2024, 06 pages.

Examination Report received for United Kingdom Patent Application No. GB2401097.7, mailed on Jun. 26, 2024, 03 pages.

Office Action received for European Patent Application No. 21737356.2, mailed on Aug. 5, 2024, 05 pages.

* cited by examiner

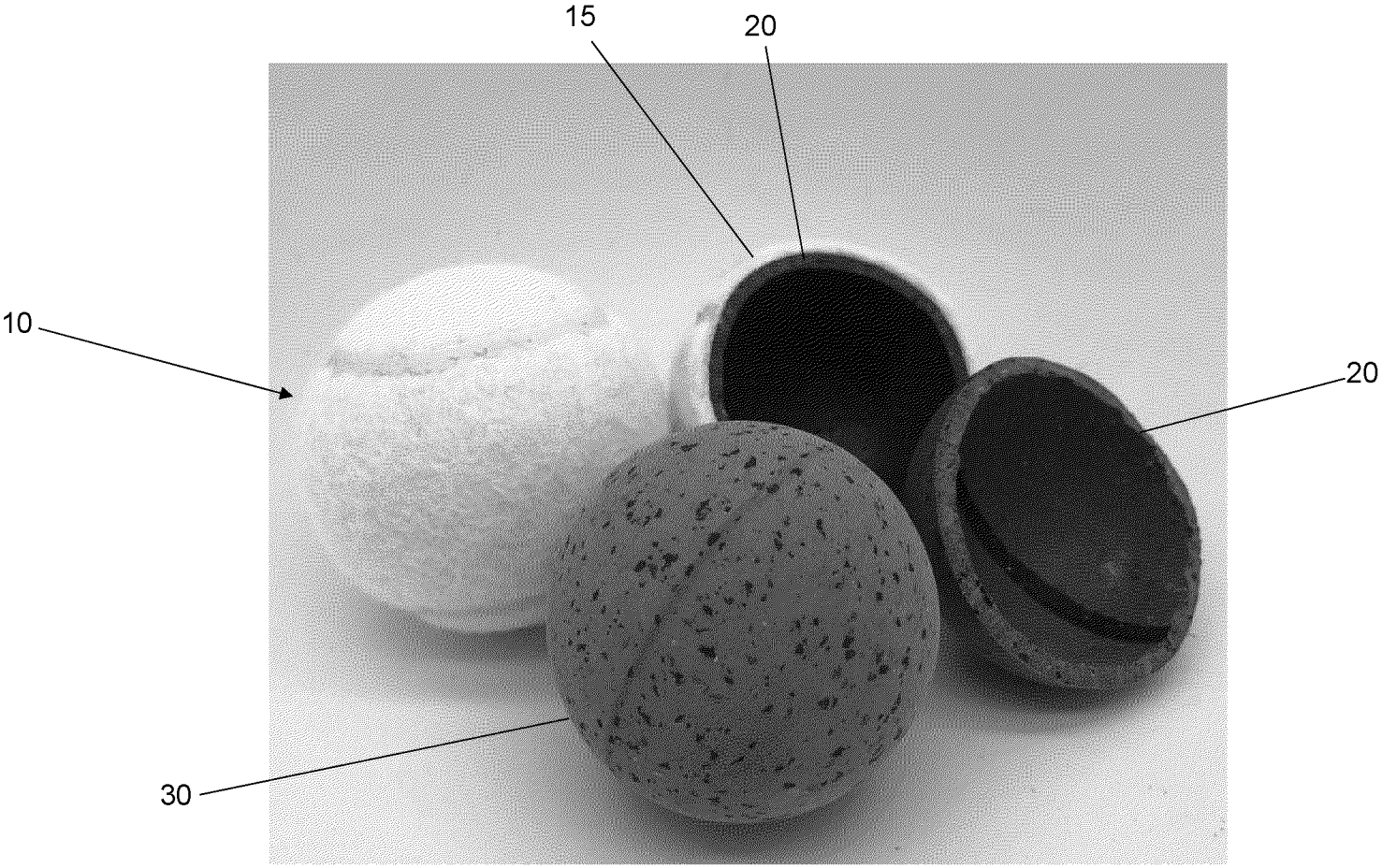
20
15
20
10
30

TENNIS BALLS

The present invention relates generally to a ball and particularly, although not exclusively, to a tennis ball, formulations therefore and methods of production thereof.

A tennis ball is a ball designed for the sport of tennis. It is typically required to be manufactured to a standard specification defined in terms of size, weight and degree of bounce, for example the specifications set by the Lawn Tennis Association (LTA) or the International Tennis Federation (ITF).

Typically tennis balls are made of a hollow, two-piece rubber shell filled with air or nitrogen.

The rubber shell is traditionally coated with a cover of with fibrous felt\cloth (for example made from cotton, wool and nylon.

Each year approximately 325 million tennis balls are produced, which contributes roughly 20,000 tonnes of waste in the form of rubber/felt/cloth that is not easily biodegradable.

The present invention seeks to provide improvements in or relating to the field of tennis balls and in particular to the recycling of tennis balls.

In a typical recycling process, collected tennis balls will comprise a variety of different types of balls, including non-pressurised ("pressureless") balls, pressurised balls, children's and beginner's balls; and from many different manufacturers and consequently of variable composition.

Even if the covers are removed the remaining rubber will have variable characteristics as a result of either initial manufacture or subsequent ageing.

Generally speaking it is impracticable to sort balls into individual types, different manufacturers products, or ball age so when reduced to a usable form, by ways well known to those versed in rubber processing, a variable starting material for recycling results.

Because of this variability, and the requirement to maintain new ball performance, it has not been possible up to this point in time to recycle used tennis balls back into tennis balls. Rubber manufacturers and ball makers have considered this problem for a considerable period.

The present invention relates in part to the use of recycled tennis ball material in new tennis balls, made to official standards, at a reasonable cost.

It may be possible to use recycled material in small quantities without affecting performance, but this would be uneconomic because balls collected would usually be a mixture of types, brands and age producing a variable material which incorporated into a tennis ball formulation would give a product not to approved standards and the costly formulation modifications needed would make the finished balls expensive.

A minor percentage of recycled ball rubber could be added to a standard tennis ball formulation and it might produce a ball within required tennis ball standards. However, the greater the amount of recycled rubber added the greater the variation and the resulting balls might not then reliably meet required standards.

The present inventors have developed novel formulations and processes to increase the reliability with which old tennis balls can be recycled back into new balls whilst continuing to meet standard specifications, even with a substantial percentage of recycled content.

An aspect of the present invention provides a tennis ball comprising a hollow core and a cover, the core being formed from a composition comprising rubber, in which the composition comprises recycled material.

An aspect of the present invention provides a tennis ball comprising a hollow core and a cover, the core being formed from a composition including rubber, in which the composition comprises recycled rubber.

The core composition may comprise a proportion of recycled rubber and a proportion of unrecycled, new or virgin rubber.

At least some of the recycled content/material may be derived from tennis balls.

The recycled content may comprise recycled coatings from recycled tennis balls.

The core may comprise at least one rubber selected from a group of rubbers consisting of or comprising: natural rubber, polybutadiene, isoprene, styrene-butadiene rubber, EPDM rubber, chemically modified rubber (e.g. trade name GS POLY 49 HS), Methyl Methacrylate with natural rubber, and mixtures thereof.

The ball may have a generally uniform outer surface consisting of a fabric cover.

An aspect of the present invention provides a tennis ball comprising a hollow core and a cover, the core being formed from a composition including rubber, in which the composition comprises recycled tennis ball material.

The core composition may comprise a proportion of recycled rubber and a proportion of unrecycled, new or virgin rubber.

At least some of the recycled tennis ball material may comprise the cores of old tennis balls.

At least some of the recycled tennis ball material may comprise the covering of old tennis balls.

At least some of the recycled rubber content may be derived from tennis balls.

The recycled content may comprise tennis ball fibres from the recycled coatings on the recycled tennis balls.

The ball may be a pressurised tennis ball.

The ball may be a pressureless tennis ball.

Also provided is a tennis ball incorporating recycled tennis balls, which comprises: a) moulded ball core half shells joined to form a ball; and b) a cloth coating on the ball.

The core half shells may comprise a core formulation comprising fibres from the recycled coatings on the recycled tennis balls.

Balls formed in accordance with the present invention may comprise thermally expanded microspheres.

Also provided is a tennis ball incorporating recycled tennis balls which comprises: a) moulded ball core half shells joined to form a ball; and b) a cloth coating on the ball; c) wherein the core half shells comprise a core formulation comprising fibres from the recycled coatings on the recycled tennis balls.

The core formulation may comprise one or more of: kieselguhr, Clay LMC, Calcium carbonates, Resins, Rosins, carbon black, silica.

Also provided is a tennis ball comprising a hollow core formed from a formulation as described herein.

Also provided is a process of making a hollow rubber ball which incorporates recycled rubber balls comprising the steps of: a) forming a batch of said recycled rubber balls and reducing it to granules by maceration and/or grinding; b) combining the recycled granules with virgin rubber and, optionally, other additives to form a core formulation; c) producing ball core half shells by forming the core formulation in a suitable mould; d) curing the formulation; e) joining the half shells to form a ball core and curing the ball core.

Step d) could be carried out at a temperature of from 120-160° C. or from 120 to 180° C. (e.g. if injection moulded).

The cured ball core may be coated with a cloth covering to form a new tennis ball.

The new tennis ball may be tested against specified criteria selected from weight, size, bounce and compression.

Additives may be adjusted according to type or quantity depending on the results of the testing to conform the new tennis ball to a set of regulations.

Additives may include an expanding thermoset resin.

The new tennis ball may be a non-pressurised or a pressurised ball.

The additives may, for example, include one or more of kieselguhr, Clay LMC, Calcium carbonates, Resins, or Rosins, carbon black, silica.

The recycled rubber balls may be partially or wholly cloth covered tennis balls.

Also provided is a ball formed by a process as described herein. Balls may meet ITF and/or LTA specifications.

In some embodiments the resulting formulation has a Shore A hardness in the range 72-80, for example 75-77.

In some embodiments the recycled material component consists of substantially only the rubber of the balls to be recycled. In other embodiments complete balls comprising both rubber and felt/cloth covers may be used. In some embodiments the method includes the step of separating the rubber material and the covering material.

The present invention may provide and/or relate to the incorporation of granulated/crumbed tennis core rubber or the whole ball back into new tennis balls. The process may include the step of granulating or crumbing of rubber tennis ball cores. The process may include the step of providing whole tennis balls i.e. inner core plus outer cover.

The formulation may contain both recycled and non-recycled rubber.

In some embodiments, for example, the rubber is provided in crumbed form, for example up to 1 mm crumbs.

Using granulated or crumbed whole tennis balls may be preferred as it is difficult and/or uneconomic to completely remove the cloth or felt coatings from the tennis balls to be recycled.

A consequence is that the cores of the new tennis balls comprise fibres from the recycled balls. It has nevertheless been found that, by using the processes and formulations described herein, new tennis balls can be made which incorporate the fibres whilst still meeting the regulations for new balls.

In a preferred embodiment granulated/crumbed whole tennis balls are combined with virgin rubber and, optionally, other additives to form a core formulation which is then used to form new tennis ball cores as described herein. Thermally expandable microspheres are one such additive and have successfully been used to enable substantial quantities of recycled material to be used in the manufacture of new tennis balls, especially of the pressureless type.

In some aspects and embodiments the quantity of recycled material is specified by a unit known as "pph" i.e. parts per hundred. The pph may be based on ("set by") the recycled rubber content.

It is noted that the term "pph" is not necessarily a % value. In some embodiments the recycled material (e.g. rubber or rubber+coating) sets a value of 100 pph, then other components are quantified relative to this value. For example if 40 kg of recycled rubber is used, then that defines a 100 pph value. 1 pph, for example, would then be 0.4 kg. In other embodiments the pph unit is established with reference to "unrecycled" rubber content.

In some embodiments the formulation is based on a "base mix" or "original mix" or "standard mix" i.e. a known mix to which further components are added (e.g. recycled material and additional additives).

The quantity of recycled ball material within a new ball may be within the range 5% to 80%, for example 10% to 75%, for example 20% to 75% or 30% to 75%. In some embodiments, for example, recycled content of 30%, 50% or 75% may be used.

The core formulation may comprise from 10-80% by weight, preferably from 20-50% by weight, more preferably from 30-50% by weight of recycled rubber balls.

Some aspects and embodiments relate to pressurised balls. Other aspects and embodiments relate to non-pressurised balls.

Tennis balls must generally conform to certain criteria for size, weight, and bounce criteria to be approved for regulation play. Some formulations herein, for example, produce balls that conform with the International Tennis Federation (ITF) specifications which define the following criteria:

Size—the diameter of a tennis ball is 6.35-6.86 cm (2.50-2.70 inches)

Weight—between 56.0 g-59.4 g (1.975-2.095 ounces)

Rebound Height—must be between 135-147 cm (53-58 inches)

Tennis balls may be tested in the following environment:

Temperature 20° C./68° F.+/−2%—

Humidity 60%+/−5%—

Atmospheric pressure 102 kPA+/−3 kPA

An outer textile cover may comprise a layer of felt/cloth adhered to a core using a rubber-based adhesive. The cover may, for example, comprise woven fibre material or needle punched felt.

The cover may, for example, comprise natural fibre (such as wool or cotton), synthetic fibre (such as nylon) or a mixture thereof.

Felt/cloth used to cover the tennis balls may, for example, be white or bright yellow. Yellow and white are the only colours approved by the ITF. Other colours may be provided for non-competition purposes.

The ball may conform to one of types specified in the table below:

| — | Type 1 (Fast) | Type 2 (Medium) | Type 3 (Slow) |
|---|---|---|---|
| Mass (Weight) | 56.0-59.4 g (1.975-2.095 oz) | 56.0-59.4 g (1.975-2.095 oz) | 56.0-59.4 g (1.975-2.095 oz) |
| Size | 6.54-6.86 cm (2.57-2.70 in) | 6.54-6.86 cm (2.57-2.70 in) | 7.00-7.30 cm (2.76-2.87 in) |
| Rebound | 138-151 cm (54-60 in) | 135-147 cm (53-58 in) | 135-147 cm (53-58 in) |
| Forward Deformation | 0.56-0.74 cm (0.220-0.291 in) | 0.56-0.74 cm (0.220-0.291 in) | 0.56-0.74 cm (0.220-0.291 in) |
| Return Deformation | 0.74-1.08 cm (0.291-0.425 in) | 0.80-1.08 cm (0.315-0.425 in) | 0.80-1.08 cm (0.315-0.425 in) |
| Colour | White or Yellow | White or Yellow | White or Yellow |

Work in Economic Sized Batches of Recycled Material.

It is suggested, for example, that a minimum weight of 50 kilos may be produced; but for the lowest production cost 1 ton or over may be desirable.

Old balls can be granulated\crumbed as collected but need to be blended afterwards, in bulk, 50 k or over, by tumbling in a barrel or other means. Possibly with, for example, 2 or 3 pph of rubber processing oil added to improve incorporation later into ball formulations.

Properties of each batch of recycled material may be tested by adding a quantity to a laboratory size standard ball formulation. A ball is then made and tested to LTA/ITF standards. The results indicate modifications required to produce a ball to required standards, which may include adding, subtracting, increasing, decreasing, ingredients, to/of a formulation to produce conforming balls.

Some of the possible variations that can be found in test balls include: too light, too heavy, reduced bounce, high or low compression and with pressurised balls even size change, normally pressurised to approximately 10 psi (0.68 bar).

There are other possible (specification and/or non-specification) changes such as reduced\increased tear or fracture resistance, or a different sound when hit with racket. The latter is not a specification requirement but better players do notice and comment on such matters. E.g.: pressureless balls, when hit, make a different sound to that of pressurised balls.

Pressurised tennis balls begin to lose their bounce as soon as the pressurised container containing the balls is opened. Modern regulation tennis balls are kept under pressure until initially used.

A hermetically sealed pressurised container, such as a metal\plastic tube may be used to contain one or more balls formed in accordance with the present invention. Recycled PET plastics containers may be used to contain balls; for example a tube with a full-top, pull-tab seal and a plastic lid may be used, with three or four balls per can/container, for example.

Also provided is a formulation for the use of recycled material in pressurised tennis balls, comprising: recycled tennis ball material; natural rubber; synthetic rubber; vulcanisation accelerator; rubber process oil.

Also provided is a formulation for the use of recycled material in pressurised tennis balls, comprising: recycled tennis ball material; natural rubber; synthetic rubber; vulcanisation accelerator; rubber process oil; kieselguhr.

Other ingredients may, for example, include Clay LMC, Calcium carbonates, Resins, Rosins, woodflour, magnesium carbonate (including light magnesium carbonate), talc, silica etc.

Also provided is a formulation for non-pressurised tennis ball containing recycled ball material, comprising: recycled tennis ball material; natural rubber; synthetic rubber; vulcanisation accelerator; rubber process oil.

Also provided is a formulation for non-pressurised tennis ball containing recycled ball material, comprising: recycled tennis ball material; natural rubber; synthetic rubber; vulcanisation accelerator; rubber process oil; kieselguhr.

The formulation may further comprise a filler.

In aspects and embodiments the ratio of recycled tennis ball material to non-recycled rubber (e.g. natural plus synthetic) may be approximately 1:1 or 1:2 or 2:1. In some embodiments, for example, the ratio may be as high as 9:1 (e.g. "900 pph").

For example, in some embodiments the quantity of recycled rubber is approximately 50 or 100 pph (with pph define by an unrecycled/virgin rubber content of 100 pph).

Recycled tennis core rubber material, or recycled whole tennis ball material may be bulk blended, in batches, before use.

Each batch of recycled material, blended in one of various known ways, is tested by incorporation into a laboratory-sized standard formulation. Test balls are made from this to be able to decide how much can be added to a new batch of tennis ball rubber compound and what necessary modifications are needed to comply with/meet required specifications.

Such modifications required, known to those experienced in rubber compounding and tennis ball formulating, could include:

- adding to or subtracting, increasing, decreasing, any ingredient of the formulation;
- introducing other materials necessary to produce correct ball characteristics.

To manage material availability and cost restraints, all formulations can be and have been modified using other ingredients, for example:

The filler range of materials may, for example, include one or more of: clay, carbon black, keiselguhr, calcium carbonate, woodflour, magnesium carbonate (including light magnesium carbonate), talc, silica.

Curatives may include: MBTS (2,2' Benzothiayl disulphide). MBT 2-Mercapttobenzothiazole.

Polymers, in varying proportions, may include: styrene butadiene rubber (SBR); polyisoprene; ethylene propylene diene monomer (EPDM); all natural rubber types.

Resins and/or Rosins.

Accelerators such as CBS.

Natural Rubber is an elastic substance obtained from the latex sap of trees, especially those trees which belong to the genera Hevea and *Ficus*. Technically speaking, natural rubber is an elastomer or an elastic hydrocarbon polymer. Natural rubber is one of the types of rubber that also include vulcanized rubber which is finished into a variety of rubber products. Natural rubber is also known by the names of India rubber, gum elastic, and caoutchouc.

Some formulations are based on a "standard formulation" i.e. a known formulation for known tennis balls with no recycled content, to which recycled tennis ball material (core and/or cover) is introduced, together with additional additives in order to allow incorporation of the recycled content and yet still produce a ball which can meet required specification.

Amounts of the various components discussed below could, for example, be present +/−1% 5%, 10%, 20%, 30%, 40%, 50%, 60%, 70%, 80%, 90% or 100% of any of those exemplified below in a final formulation.

Formulations in accordance with the present invention may comprise one or more of the following components (in any combination thereof).

Pressurised

| | |
|---|---|
| Natural Rubber | 0-100 pph |
| Polybutadiene | 10-70 |
| Zinc Oxide | 1-10 |
| Stearic Acid | 1-3 |
| Antioxidant | 0.5-1 |
| Clay | 5-80 |
| Light mag carbonate (LMC) | 5-80 |
| MC Sulphur | 0.1-7 |
| DPG | 0.1-4 |
| CBS | 0.1-4 |
| TMTD | 0.1-1 |
| Recycled tennis ball material | 50-1000 |
| Rubber process oil | 1-20 |
| Keiselguhr | 1-85 |

In some embodiments calcium carbonate is added to adjust weight.

Pressureless

| | |
|---|---|
| (Hi Cis) Polybutadiene | 10-70 pph |
| Natural rubber | 0-100 |
| Zinc Oxide | 1-10 |
| Stearic acid | 1-3 |
| antioxidant | 0.1-1 |
| Sulphur | 0.1-7 |
| Carbon Black | 1-40 |
| Wood flour | 1-20 |
| Thermally expandable microspheres | 1-10 |
| Oil | 1-20 |
| Recycled tennis ball material | 50-1000 |
| DPG | 0.1-4 |
| CBS | 0.1-4 |
| Keiselghur | 1-85 |

In some embodiments high styrene resin and/or phenolic resin (HSR) is included at approximately 1-25 pph, for example 1-20 pph or 1-15 pph.

Some embodiments include phenolic resin e.g.

SMR 75

Polybutadiene 25

Zinc Oxide—5

Stearic Acid—1

Antioxidant—1

Calcium Carbonate—42

GPF—16

Light Magnesium Carbonate—24

CBS—3

DPG—3

PEG—0.3

Sulphur 3

Phenolic Resin—7

This could, for example, include 30-60 pph recycled tennis ball material e.g. 30, 50 or 56 pph.

The details of any of the formulations could be combined with any of the other formulations.

In some embodiments a test ball is produced from a batch, then tested before determining if further modifications are required.

Also provided is a container (such as a can/tube) with one or a plurality of balls formed in accordance with the present invention.

Methods of forming tennis balls in accordance with the present invention may comprise one or more of the following steps:

preparing a rubber "slug"

forming (e.g. moulding) half shells curing half shells forming a core introducing pressurised gas (e.g. air) into the core roughening the surface of the core applying adhesive to the core preparing felt e.g. cutting woven felt (e.g. wool+nylon; some embodiments may include no nylon to avoid microplastics) into "dogbones"

dipping the felt in adhesive (this may form seams)

apply felt to the core flatten the felt final cure steam bath inspection stamping (e.g. with a logo)

A further embodiment include a core formulation having approximately (e.g. +/−10%) the following ingredients:

SMR 80 pph

Polybutadiene 20

Zinc Oxide—12

Stearic Acid—1

Antioxidant—1

Clay—20

Calcium Carbonate—6

Light Magnesium Carbonate—40

MBTS—2

DPG—2

PEG—2

Sulphur 4

High Styrene Resin 10

Tennis ball recycled material 50

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, by way of example.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments are described in detail below only as examples. There is no intent to limit to the particular forms disclosed. On the contrary, all modifications, equivalents, and alternatives falling within the scope of the appended claims should be included.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In some aspects and embodiments the intention is to make quality balls, at an economic cost, with a useful percentage of recycled material included.

Examples of and relating to formulations of pressurised and non-pressurised and test results are provided below. Amounts for alternative formulations may include components with the same, substantially the same or within a tolerance of, for example, 10% of the amounts for any of the components shown.

1. Pressurised Tennis Balls

A Standard Pressurised Tennis Ball Formulation of Prior Art

Rubber Hydrocarbon Content (RHC)=100 parts

| | |
|---|---|
| Natural Rubber | 66 parts per hundred (pph) |
| Polybutadiene (preferably hi cis) | 34 |
| Additives | |
| Zinc Oxide | 4 |
| Stearic acid | 1 |
| Antioxident | 1 |
| Clay | 29 |
| Light mag carbonate | 38 |
| Sulphur | 3.75 |

-continued

| | |
|---|---|
| DPG | 2.26 |
| CBS | 2.26 |
| TMTD | 0.25 |

Polybutadiene (butadiene rubber BR) is a synthetic rubber, high cis polybutadiene is characterized by a high proportion of cis (typically over 92%) and a small proportion of vinyl (less than 4%). Polybutadiene increases the resilience of the formulation. However, if it is present at too high a pph it can render the resulting ball brittle.

DPG=1,3-diphenylguanadine acts as a middle-speed accelerator, suitable for natural and synthetic rubber.

CBS=N-Cyclohexyl-2-benzothiazolesulfenamide is a vulcanisation accelerator.

TMTD=Tetramethylthiuram disulfide is a vulcanisation accelerator.

DPG, CBS and TMTD are examples of accelerators (chemicals that speed up vulcanisation).

Light magnesium carbonate is a semi-reinforcing filler. Carbon black and/or silica could alternatively or additionally be used.

The sulphur is curative. It may, for example, be provided in the form of magnesium sulphate, for example in the range 2-5 pph.

There can be many variations to a standard formulation to obtain results to meet ITF and LTA standards.

According to the invention a modified Pressurised tennis formulation with recycled tennis ball material added.

EXAMPLE 1.1

Standard Formulation as Describe Above ("Base Mix") Plus:

- 100 pph recycled tennis ball material based on the rubber hydrocarbon of standard formulation (i.e. there is approximately a 1:1 ratio of recycled material and unrecycled material in this embodiment)
- 1.5 pph additional Sulphur based on the recycled tennis ball material added
- 1.5 pph additional DPG based on the recycled tennis ball material
- 1.5 pph additional CBS based on the recycled tennis ball material
- 3 pph non staining oil based on the recycled tennis ball material
- 6 pph keiselguhr based on the standard mix RHC It is noted that the term pph is not a % value. The RHC of the standard formulation sets a value of 100 pph. The recycled content is set at 100 pph in this embodiment (i.e. a 1:1 ratio). In this embodiment the recycled tennis ball material sets a value of 100 pph, then other components are quantified relative to this value. For example if 40 kg of rubber is used, then that defines a 100 pph value. 1 pph, for example, would then be 0.4 kg. As a further example, 1 kg of recycled tennis ball recycled material may be added. 1.5 pph of DPG would therefore be 15 g i.e. this is based on the recycled tennis ball material and not the total rubber content. It will be appreciated that the pph content for the additives could be set by the unrecycled rubber content and/or by the recycled material content.

The oil may be rubber process oil, such as paraffinic oil. The oil "wets" the surface of the crumbed rubber, allowing it to incorporate more easily.

This formulation contains both recycled and non-recycled rubber.

In some embodiments, for example, the rubber is provided in crumbed form, for example up to 1 mm crumbs.

In this embodiment an added amount of sulphur is used compared to a standard tennis formulation. This is to help re-process the aged rubber, which will have oxidised to a degree over time -( and therefore will have lost some properties.

Accelerators are included to help with vulcanisation.

Keiselguhr is a semi-reinforcing filler. Diatomaceous earth, diatomite or kieselgur/kieselguhr is a naturally occurring, soft, siliceous sedimentary rock that is easily crumbled into a fine white to off-white powder. Typically it has a particle size ranging from less than 3 μm to more than 1 mm, but typically 10 to 200 μm.

As crumbed recycled tennis ball material varies in many ways it has been found that kieselguhr helps to provide more consistency. It has also been found that the addition of keiselguhr affects the bounce of balls less than some other fillers.

In some embodiments whole tennis balls, including the felt/cloth covering, are used to provide recycled content.

This formulation is moulded into half core shells and combined and covered with cloth and tested. Test Balls produced from this formulation results weight 58 grams, Rebound 54", Compression 270 are to ITF balls standards.

Test balls meeting the required standards have been produced using 900 pph of recycled tennis ball material, based on the standard formulation RHC. At this level the % weight of recycled material comprises 75% of the complete ball.

Possible useful range of recycled tennis ball material is 10-900 pph based on RHC.

Further formulations for the use of recycled material in pressurised tennis balls

EXAMPLE 1.2

Standard Pressurised Formulation Plus 100 pph of Recycled Material

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| Test Ball results | 55 g | 0.290 | 51-52 | 6.7 |

This produces a ball that is out of specification in regards to the rebound and weight. A series of amendments were carried out.

The Final Corrective actions taken:

(a) Ratio pph of natural rubber and polybutadiene reversed from 66 \ 34, to 34 \ 66

(b) Keiselghur added.

(c) Increased amounts of curatives.

Formulation 1.2 with Corrective Actions Included:

| | |
|---|---|
| Natural Rubber | 34 pph |
| Polybutadiene | 64 pph |
| Zinc Oxide | 4 |
| Stearic Acid | 1 |
| Antioxidant | 1 |
| Clay | 29 |
| Light mag carbonate | 38 |
| MC Sulphur | 5.25 |

-continued

| | |
|---|---|
| DPG | 3.76 |
| CBS | 3.76 |
| TMTD | 0.25 |
| Recycled tennis ball material | 100 |
| Rubber process oil | 3 |
| Keiselguhr | 6 |

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| Test Ball results | 58 g | 0.270 | 54" | 6.67 |

This produces a ball that meets ITF ball standards.

EXAMPLE 1.3

Standard Pressurised Formulation Plus 50 pph of Recycled Material.

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| | 56 g | 0.300 | 56 | 6.6 |

This produces a ball that is out of specification in regards to the deformation. A series of amendments were carried out.

The Final Corrective actions taken:

(a) Keiselghur added.

(b) LMC reduced (c) Sulphur decreased (d) Decreased amounts of curatives.

(e) Natural rubber and Polybutadiene ratio changed,

Formulation 1.3 with Corrective Actions Included for Pressurised Tennis Balls

| | |
|---|---|
| Natural Rubber | 64 pph |
| Polybutadiene | 36 pph |
| Zinc Oxide | 4 |
| Stearic Acid | 1 |
| Antioxidant | 1 |
| Clay | 29 |
| Keisulghur | 38 |
| Light mag carbonate | 10 |
| Sulphur | 3.75 |
| DPG | 2.26 |
| CBS | 2.26 |
| TMTD | 0.25 |
| Recycled tennis ball material | 50 |

| | Weight | Deformation compression? | Rebound | Size |
|---|---|---|---|---|
| ITF SPECS | 56-59.4 g | 0.220-0.291 inches (0.56-0.74 cm) | 53" to 58" (135-147 cm) | 6.54-6.86 cm (2.57-2.70") |
| Test Ball | 57 g | 0.260 | 55 | 6.67 |

This produces a ball that meets ITF ball standards.

EXAMPLE 1.4

Standard Pressurised Formulation Plus 183 pph of Recycled Material,

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| | 58 g | 0.180 | 52 | 6.54 |

This produces a ball that is out of specification in regards to the rebound and deformation. A series of amendments were carried out.

The Final Corrective actions taken:

(a) Keiselghur added.

(b) LMC and Clay reduced (c) Sulphur increased (d) Decreased amounts of curatives.

(e) Natural rubber and Polybutadiene ratio changed,

Modified Formulation 1.4, for Pressurised Tennis Balls

| | |
|---|---|
| Natural Rubber | 65 pph |
| Polybutadiene | 35 pph |
| Zinc Oxide | 4 |
| Stearic Acid | 1 |
| Antioxidant | 1 |
| Clay | 14 |
| Keisulghur | 66 |
| Light mag carbonate | 10 |
| Sulphur | 5 |
| DPG | 2.8 |
| CBS | 2.8 |
| TMTD | 0.5 |
| Recycled tennis ball material | 183 |

| | Weight | Deformation compression? | Rebound | Size |
|---|---|---|---|---|
| ITF SPECS | 56-59.4 g | 0.220-0.291 inches (0.56-0.74 cm) | 53" to 58" (135-147 cm) | 6.54-6.86 cm (2.57-2.70") |
| Test Ball | 57 g | 0.290 | 56 | 6.6 |

This produces a ball that meets ITF ball standards.

2. Pressureless Balls

Use of Recycled Tennis Ball Material (e.g. Rubber and/or Cover) in Non-Pressurised\ Pressureless Balls Recycled tennis ball material can be added to a non-pressurised ball formulation. Amounts are reduced compared with pressurised balls because pressureless balls have a thicker wall section and therefore a lower Specific Gravity than pressurised balls (which account for the larger percentage of balls sold in the world), the principle of which is discussed above.

It is more difficult as the recycled rubber\material will vary in weight and it will tend to be heavier than normal pressureless rubber, thereby limiting its use.

Pressureless formulations have been successfully modified by reducing the Specific Gravity, thereby allowing increased quantities of recycled ball rubber/material to be included.

Approximately one third of the tennis balls sold in the world are of the pressureless type, 10% other types (such as mini tennis balls, play & stay balls and junior tennis balls) the remainder are pressurised. Pressurised tennis balls are the same weight and size as non-pressurised balls, but approximately two thirds of the wall thickness/rubber volume, indicating a higher specific gravity. Batches of recycled material from these balls will be typically denser than normal pressureless ball rubber, thereby limiting its use in non-pressurised balls.

Amounts of recycled material it is possible to incorporate are reduced because pressureless tennis balls have a thicker rubber section than pressurised balls; therefore they have a lower Specific Gravity, than pressurised balls (as discussed above).

The present inventors have successfully modified and reduced the Specific Gravity of a standard pressureless ball formulation, thereby allowing a larger percentage of the heavier recycled material to be incorporated.

Some aspects and embodiments are based on the use of ingredients with lower specific gravities and the use of expandable microspheres and replacing or reducing ingredients of higher specific gravities.

A Standard non-pressurised\pressureless formulation of the prior art

| | |
|---|---|
| Hi cis Polybutadiene | 33 pph plus Natural Rubber 67 pph = 100 pph RHC |
| High Styrene Rubber SS260 | 10 pph based on RHC |
| Zinc Oxide | 5 |
| Stearic Acid | 1 |
| Antioxidant | 1 |
| Sulphur | 3.75 |
| Clay | 20 |
| Carbon Black | 17 |
| Wood flour | 10 |
| Oil | 4 |
| DPG | 2.54 |
| CBS | 2.54 |

| | Weight | Deformation | Rebound | Size |
|---|---|---|---|---|
| ITF Specification | 56-59.4 g | 0.220-0.291 inches (0.56-0.74 cm) | 53" to 58" (135-147 cm) | 6.54-6.86 cm (2.57-2.70") |
| Test Ball results | 59 g | 0.275 | 54 | 6.7 |

This produces a ball that meets ITF ball standards.

EXAMPLE 2.1

According to the Invention a Modified Pressureless Tennis Ball Formulation with Recycled Rubber Added Hi Cis Polybutadiene 33 pph, Natural Rubber 67 pph=100 pph RHC

| | |
|---|---|
| Zinc Oxide | 2 pph |
| Stearic acid | 1 pph |
| antioxidant | 1 pph |
| Sulphur | 3.75 pph |
| Carbon Black | 12 pph |
| Wood flour | 15 pph |
| Thermally expandable microspheres | 5 |
| Oil | 12 pph |
| Tennis ball recycled material | 30 pph |
| DPG | 2.54 pph |
| CBS | 2.54 pph |

The expandable microspheres may be, for example, the Expancel range, available from Boud Minerals.

The oil may, for example, be rubber process oil.

Example quantity of recycled rubber 50 or 100 pph of RHC (i.e. recycled content pph is based on non-recycled rubber content).

However, 5 to 200 pph based on RHC has been used producing balls to specification but the higher loading taking considerably longer to incorporate.

Formulations for Non-Pressurised Tennis Ball Containing Recycled Ball Material

EXAMPLE 2.2

| | |
|---|---|
| Natural rubber | 67 |
| Polybutadiene rubber | 33 |
| High Styrene rubber SS260 | 10 |
| Zinc Oxide | 2 |
| Stearic Acid | 1 |
| Antioxidant | 1 |
| MC Sulphur | 3.75 |
| GPF Black | 12 |
| Wood flour | 15 |
| Expanded thermoset or thermoplastic resin | 5 |
| Rubber process oil | 12 |
| Recycled ball material | 50 |
| DPG | 2.54 |
| CBS | 2.54 |

Test Ball Results:

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| | 56 g | 0.350 | 52 | 6.6 |

This produces a ball that is out of specification in regards to the rebound and deformation. A series of amendments were carried out.

Corrective Actions a. Reduce oil to 4 pph b. Add keiselghur 20 pph c. Reverse ratio of natural rubber and polybutadiene rubber

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| | 58 g | 0.275 | 55 | 6.59 |

Adjusted Formulation/Modified Mix

| | |
|---|---|
| Natural rubber | 33 |
| Polybutadiene rubber | 67 |
| High Styrene rubber SS260 | 10 pph |
| Zinc Oxide | 2 |
| Stearic Acid | 1 |
| Antioxidant | 1 |
| MC Sulphur | 3.75 |
| GPF Black | 12 |
| Wood flour | 15 |
| Expanded thermoset or thermoplastic resin | 5 |
| Rubber process oil | 8 |
| Recycled ball material | 50 |
| DPG | 2.54 |
| CBS | 2.54 |
| Keiselghur | 20 |

EXAMPLE 2.3

Standard Formulation for Non-Pressurised Balls Plus Recycled Ball Material 30 PPH

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| TEST BALL | 60/61 | 0.180 | 52 | 6.54 |

This produces a ball that is out of specification in regards to the deformation, rebound and weight. A series of amendments were carried out.

The Final Corrective actions taken:

Corrective actions:

a. Added 7 pph oil b. Changed ratio of Natural rubber and polybutadiene to 50/50 pph RHC Adjusted formulation/modified mix

| | |
|---|---|
| Natural rubber | 50 |
| Polybutadiene rubber | 50 |
| High Styrene rubber SS260 | 10 pph |
| Zinc Oxide | 2 |
| Stearic Acid | 1 |
| Antioxidant | 1 |
| MC Sulphur | 3.75 |
| GPF Black | 12 |
| Wood flour | 15 |
| Expanded thermoset or thermoplastic resin | 5 |
| Rubber process oil | 19 |
| Recycled ball material | 50 |
| DPG | 2.54 |
| CBS | 2.54 |

| | Weight | Deformation | Rebound | Size |
|---|---|---|---|---|
| ITF specification | 56-59.4 g | 0.220-0.291 inches (0.56-0.74 cm) | 53" to 58" (135-147 cm) | 6.54-6.86 cm (2.57-2.70") |
| Test balls | 57 g | 0.275 | 54 | 6.62 |

This produces a ball that meets ITF ball standards.

Compression tests were carried out using a Stevens machine.

Further Example of a Pressurised Ball Mix

SMR . . . 74 pph
Zinc Oxide . . . 13
Stearic Acid . . . 1
DPG . . . 2
LMC . . . 42
Hard Clay . . . 21
Sulphur . . . 3.7
MBTS . . . 2
PEG(polyethylene gycol group) . . . 2
Poly butadiene . . . 1220 . . . 21
High Styrene Resin SS260 . . . 10
Calcium Carbonate . . . 10
Recycled tennis ball material . . . 50

Further example of a pressurised ball core formulation mix

SMR 80 pph
Polybutadiene 20
Zinc Oxide—12
Stearic Acid—1
Antioxidant—1
Clay—20
Calcium Carbonate—6
Light Magnesium Carbonate—40
MBTS—2
DPG—2
PEG—2
Sulphur 4
High Styrene Resin 10
Tennis ball recycled material 50
+/−10%

With or without recycled ball cover material in the tennis ball recycled material.

There are other possible ways of incorporating old tennis balls.

Balls for recycling may be granulated, mixed with a reclaiming 'oil', and subjected to heat.

Generally speaking any temperature over boiling point will work over a period of time but for economic reasons the higher the temperature the quicker reclaiming takes place.

One problem of using reclaimed material for tennis balls is that hardness and resilience of the reclaimed material is lower and recovering the correct ball parameters becomes more difficult.

Multi blending may be necessary to produce large uniform batches. It may not be a preferred way of incorporating recycled ball material because the greater use of energy and increased correction time involved.

FIG. 1 shows:

10 complete tennis ball formed according to the present invention
15 fabric cover
20 core half shell
30 core (complete)

Although illustrative embodiments of the invention have been disclosed in detail herein, it is understood that the invention is not limited to the precise embodiments shown and that various changes and modifications can be effected therein by one skilled in the art without departing from the scope of the invention.

The invention claimed is:

1. A tennis ball comprising a hollow core and a fabric cover, the hollow core being formed from a composition including rubber, in which the composition comprises recycled rubber, wherein the composition comprises fibres from recycled coatings on recycled tennis balls.

2. A tennis ball according to claim 1, wherein at least some of the recycled rubber is derived from recycled tennis balls.

3. A tennis ball according to claim 1, wherein the hollow core comprises two molded ball core half shells joined to form the ball.

4. A tennis ball according to claim 1, wherein the recycled rubber is present in the range 5% to 80%.

5. A tennis ball according to claim 1, wherein the fabric cover comprises a cloth coating on the ball.

6. A tennis ball comprising a hollow core and a fabric cover, the hollow core comprising two molded ball core half shells joined to form the ball, the half shells being formed from a composition comprising a proportion of recycled content and a proportion of unrecycled, new or virgin rubber, in which the recycled content is present in a range 5% to 80%, and in which the ball conforms to one or more of the following criteria:

i) a diameter of between 6.35 cm and 6.86 cm; a weight of between 56.0 g and 59.4 g; and a rebound height of between 135 cm and 147 cm;

ii) a diameter of between 6.54 cm and 6.86 cm; a weight of between 56.0 g and 59.4 g; and a rebound height of between 138 cm and 151 cm;

iii) a diameter of between 6.54 cm and 6.86 cm; a weight of between 56.0 g and 59.4 g; and a rebound height of between 135 cm and 147 cm; and iv) a diameter of between 7.00 cm and 7.30 cm; a weight of between 56.0 g and 59.4 g; and a rebound height of between 135 cm and 147 cm, wherein the composition comprises fibres from recycled coatings on recycled tennis balls.

7. The ball as claimed in claim 6, in which at least some of the recycled content is derived from recycled tennis balls.

8. The ball as claimed in claim 7, in which the recycled content comprises tennis ball fibres from recycled coatings on the recycled tennis balls.

9. The ball as claimed in claim 6, in which the composition comprises rubber selected from a group of rubbers consisting of: natural rubber, polybutadiene, isoprene, styrene-butadiene rubber and mixtures thereof.

10. The ball as claimed in claim 6, in which the ball has a generally uniform outer surface consisting of the fabric cover.

11. The ball as claimed in claim 6, in which the ball is a pressurized tennis ball.

12. The ball as claimed in claim 6, in which the ball is a pressureless tennis ball.

13. The tennis ball as claimed in claim 6, in which the fabric cover comprises a cloth coating on the ball.

14. The ball as claimed in claim 6, comprising thermally expanded microspheres.

15. The tennis ball according to claim 6, in which the composition comprises kieselguhr.

16. The ball according to claim 6, wherein the core formulation comprises from 10-80% by weight, from 20-50% by weight, or from 30-50% by weight of recycled rubber balls.

* * * * *